US006941786B1

(12) United States Patent
Cooper et al.

(10) Patent No.: US 6,941,786 B1
(45) Date of Patent: Sep. 13, 2005

(54) COMPONENT SPECIFIC TUBE BLANKS FOR HYDROFORMING BODY STRUCTURE COMPONENTS

(75) Inventors: Geoffrey Cooper, Canton, MI (US); Corey Jarocki, Harrison Township, MI (US); Armando Joaquin, Rochester Hills, MI (US); Carlos Perez, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/809,025

(22) Filed: Mar. 25, 2004

(51) Int. Cl.[7] ..... B21D 26/02; B21D 39/20
(52) U.S. Cl. ..... 72/58; 72/57; 72/61; 29/421.1
(58) Field of Search ..... 72/56, 58, 60, 72/61, 55, 57; 29/421.1

(56) References Cited

U.S. PATENT DOCUMENTS

| | | | | |
|---|---|---|---|---|
| 3,768,288 | A * | 10/1973 | Jury | 72/61 |
| 4,751,835 | A * | 6/1988 | Galaniuk et al. | 72/62 |
| 5,445,001 | A * | 8/1995 | Snavely | 72/55 |
| 5,735,156 | A * | 4/1998 | Yoshitomi et al. | 72/57 |
| 6,266,986 | B1 * | 7/2001 | Morita et al. | 72/58 |
| 6,519,855 | B1 * | 2/2003 | Marando | 29/421.1 |
| 6,701,764 | B2 * | 3/2004 | Bruck et al. | 72/62 |

* cited by examiner

*Primary Examiner*—David Jones
(74) *Attorney, Agent, or Firm*—Gigette M. Bejin

(57) ABSTRACT

A hydroforming system includes a dual conical tube formed from a blank. The dual conical tube has a first end, a second end and a central portion positioned between the first and the second ends. The central portion has a smaller cross sectional area than the first and the second ends. A shaping die is adapted to receive the dual conical tube, and the shaping die is subject to pressurize such that the tube substantially approximates the shape of the shaping die.

17 Claims, 3 Drawing Sheets

COMPONENT SPECIFIC TUBE BLANKS FOR HYDROFORMING BODY STRUCTURE COMPONENTS

TECHNICAL FIELD

The present invention relates generally to processes for molding automotive components and, more particularly, to a method for hydroforming component specific blanks.

BACKGROUND ART

Hydroforming is a metal forming process through which metal tube blanks are formed into shapes, such as automotive body components, through the application of internal water hydraulic pressure.

Standard hydroforming techniques start with a sheet of metal or a bent tube. Hydroforming differs from conventional deep drawing processes by replacing die tools with rubber diaphragms, which are backed with fluid pressure, to form punch tool components.

Relating the aforementioned concept to tubular parts, a tube is placed in a die, then the tube is filled with a fluid pressure to form a part to the die. In other words, the tube blanks are reshaped through cross-sectional changes along the length of the tube blanks.

Low pressure sheet forming, through which the tube is filled with a low pressure fluid that forms the part to the die, is ideal for parts with large radii, simple cross sections, and flat surfaces. High pressure sheet forming is ideal for parts requiring complex cross sections with small radii. The drawback to high pressure forming is that, due to friction, parts tend to have non-uniform thickness.

For active hydroforming, the part is placed in the hydroforming press. Before the press is cycled shut, a fluid pressure is applied to expand the part while maintaining the metal at a uniform thickness. The resulting part tends to have uniform thickness even for complex cross sections. Active hydroforming takes the strong points from high and low pressure hydroforming and combines them into a single process.

The hydroforming process allows close control of parameters (e.g. fluid pressure and lubrication) to prevent wrinkling and tearing of parts. High quality parts that are substantially hard, resistant to buckling and unlikely to have surface defects are produced through hydroforming. Improved process flow also tends to result from decreased die wear due to fluid on metal forming rather than metal on metal forming.

Hydroforming flows metal rather than stretching it. Therefore, thinning of material is minimal. This often results in material savings because thinner blanks can be used, which is an important factor in decreasing costs when expensive alloys are required or a large number of parts are ordered.

The existing stamped shape of a front rail for a unitized body has the end that the bumper attaches to flared open initially and gradually decreased in cross sectional dimensions as the rail bypasses the tire envelope on one side and powertrain on the other side. Once past the tire envelope and powertrain, the section is again increased in cross sectional dimensions as it transitions to the dash. Replacing the front stamped rail with a regular tube shape hydroformed rail requires end feeding into a hydroform press to get expansion near the ends during a hydroforming process, and this method of feeding tends to limit the degree of conical shape, which is needed for automobile body engineering requirements.

The limitation associated with current component molding techniques has made it apparent that a modified technique to mold components is necessary. The modified technique should substantially minimize steps required for a hydroforming process and should facilitate compliance with automobile body engineering requirements. The present invention is directed to these ends.

SUMMARY OF THE INVENTION

The present invention provides a method for hydroforming component specific blanks. The present invention also provides a hydroforming system that incorporates component specific blanks and a tube designed to efficiently receive and facilitate molding of the component specific blanks.

One aspect of the present invention includes a method for molding a part comprising: rolling a substantially bow tie shaped blank lengthwise to form a dual conical tube, said dual conical tube comprising a first end, a second end and a central portion positioned between said first and said second ends; inserting said dual conical tube in a metal forming device comprising a shaping die; and substantially forming through pressurization said substantially bow tie shaped blank to an approximate shape of said shaping die.

In accordance with another aspect of the present invention, a system for hydroforming, including a dual conical tube formed from a blank is disclosed. The dual conical tube has a first end, a second end and a central portion positioned between the first and the second ends. The central portion has a smaller cross sectional area than the first and the second ends. A shaping die is adapted to receive the dual conical tube and is subject to pressurize such that the blank substantially conforms to a shape of the shaping die.

One advantage of the present invention is that it facilitates efficient and versatile shaping of automotive body components. Another advantage is a decrease of package space required due to the narrow cross-section in the central portions of components manufactured from the aforementioned process. Still another advantage is the elimination of the need to add localized reinforcements due to the larger cross sectional area at the end sections.

Additional advantages and features of the present invention will become apparent from the description that follows and may be realized by the instrumentalities and combinations particularly pointed out in the appended claims, taken in conjunction with the accompanying drawings.

DETAILED DESCRIPTION

The present invention is illustrated with respect to a method for molding a component, particularly suited to the automotive field. The present invention is, however, applicable to various other uses that may require hydroformed components, as will be understood by one skilled in the art.

Figure 1A:
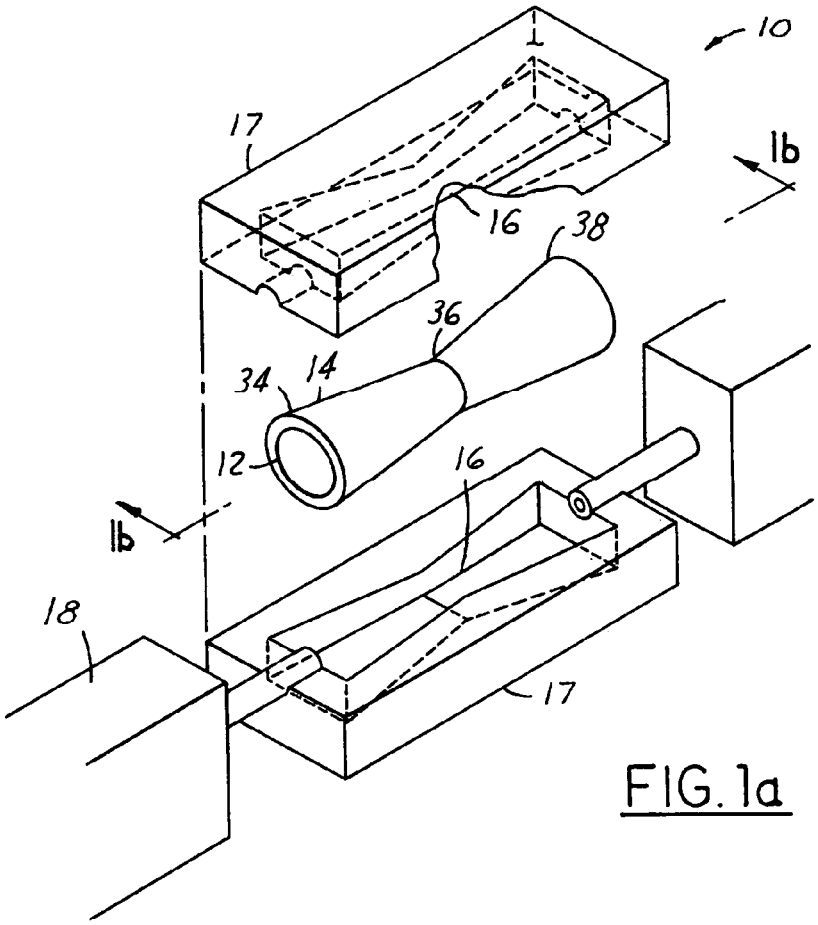
FIG. 1*a* is an exploded view of a hydroforming system in accordance with an embodiment of the present invention.
Figure 1B:
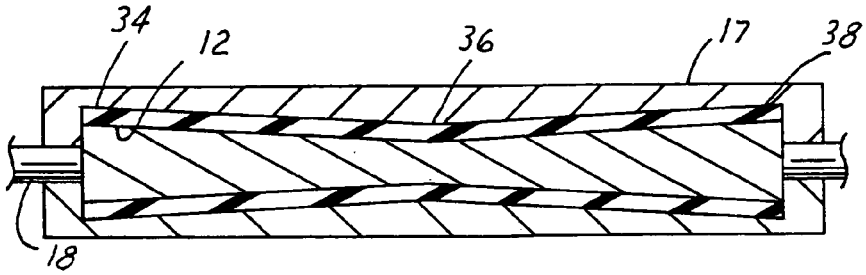
FIG. 1*b* is a cross-sectional view of the assembled hydroforming system of FIG. 1*a* in the direction of line 1*b*–1*b;*
Figures 1C, 2:
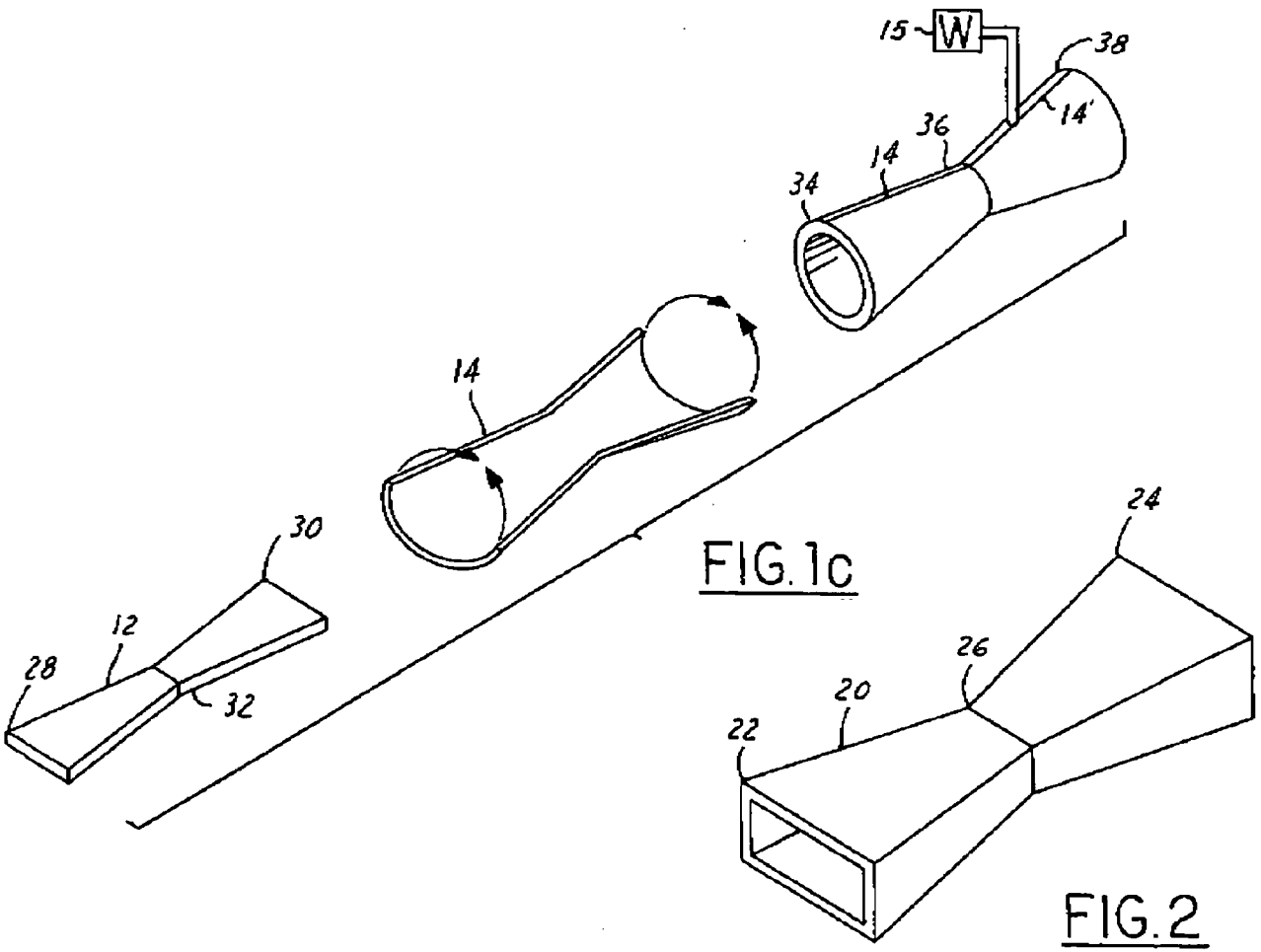
FIG. 1*c* is a perspective view of the bow tie shaped blank and the dual conical tube of FIG. 1*a;*
FIG. 2 is a perspective view of a substantially bow tie shaped part manufactured through operation of the system of FIG. 1*a* in accordance with an embodiment of the present invention.

Referring to FIGS. 1*a*, 1*b*, and FIG. 2, a dual conical tube 14 for use in a hydroforming method 10, including a substantially bow tie shaped blank 12, is disclosed. The blank 12 is adapted to be rolled to form the dual conical tube 14. The blank 12 is here illustrated as a substantially bow tie shaped blank 12, however, it is to be understood that numerous alternate blank shapes may be used depending on specific part parameters, as one skilled in the art would realize.

The substantially bow tie shaped blank 12 is reinforced, depending on material and tensile requirements for the blank 12 prior to the rolling and forming processes, as will be discussed later. Alternate embodiments of the present invention include two separate ends of the blank 12 whereby joining the two ends 28, 30 at the central portion 32, the substantially bow tie shaped blank 12 is assembled.

The blank 12 is rolled to form the dual conical tube 14, as will be understood by one skilled in the art. The tube is then welded at seams along the length of the tube between the tube ends 34, 38, and for product components requiring further bending, the tube is bent to facilitate hydroforming of the desired part 20. A shaping die 16, located within a die frame 17 and coupled to a hydroforming press 18, is adapted to receive the dual conical tube 14. The hydroforming operation then cycles, and a dual conical shaped part 20 is formed. One embodiment of a part 20 formed from the aforementioned method 10 is illustrated in FIG. 2.

Manufacturing a dual conical shaped part 20 from a single blank 12 allows a larger cross sectional diameter at the ends of the part 20 (first end 22 and second end 24) and a narrow cross sectional diameter between the ends (central portion 26) and thereby accommodates packaging and energy management requirements, as will be understood by one skilled in the art. This also reduces need for localized reinforcements due to the enlarged cross sectional diameter at the ends 22, 24.

Referring to FIG. 1*c*, a perspective view of the bow tie shaped blank 12 and the dual conical tube 14 of FIG. 1*a* is illustrated. The bow tie blank 12 is a substantially flat sheet of metal such as aluminum, though alternate flexible metals may be molded using the aforementioned method. The blank 12 is embodied as having two ends 28, 30 linked by a substantially smaller central portion 32. The sheet is either cut as a single piece or is the combination of a number of sheets greater than one welded together, as will be understood by one skilled in the art.

Reinforcements are welded to the substantially bow tie shaped blank 12 in the form of patches prior to the rolling and forming operation, as will be understood by one skilled in the art. The tailored sheet blank (bow tie blank 12) is alternately constructed using materials of varied thickness, as is well understood, for energy management.

The dual conical tube 14 necks down from one end (first end 34) to a minimum point (central point 36) then expands back out towards the other end (second end 38).

The dual conical shape blank (bow tie blank 12), which is rolled to form the dual conical tube 14, allows the hydroforming process to deliver a shape suited to match engineering energy management requirements for front crash while minimizing weight and additional reinforcements on, for example, hydroformed front rails.

The dual conical tube 14 is welded at the seam 14' via a suitable welding device 15 along the length of the tube through a well known joining method (e.g. Gas Metal Arc Welding, Tungsten Inert Gas, Laser Welding, electron beam welding, hybrid (laser-GMAW or laser-plasma) welding, friction stir welding or seam mesh welding).

The dual conical tube 14 is post processed by a tube bending operation prior to hydroforming, as one skilled in the art would realize, for components requiring bending beyond hydroforming capabilities.

After the dual conical tube 14 is sealed and bent, the shaping die 16 pressurizes the dual conical tube 14 such that it substantially conforms to a shape of the shaping die 16.

The existing stamped shape of a front rail for a unitized body has an end, that the bumper attaches to, flared open initially and gradually decreased as the rail bypasses the tire envelope on one side and powertrain on the other side. Once past the tire envelope and the powertrain, the section again increases as it transitions to the dash. Replacing the front stamped rail with a regular tube shape hydroformed rail requires end feeding of both ends individually into a hydroform press to get expansion near the ends, during the hydroform process. This former method of feeding limits the degree of conical shape, which is needed for automobile body engineering requirements.

Figure 3:
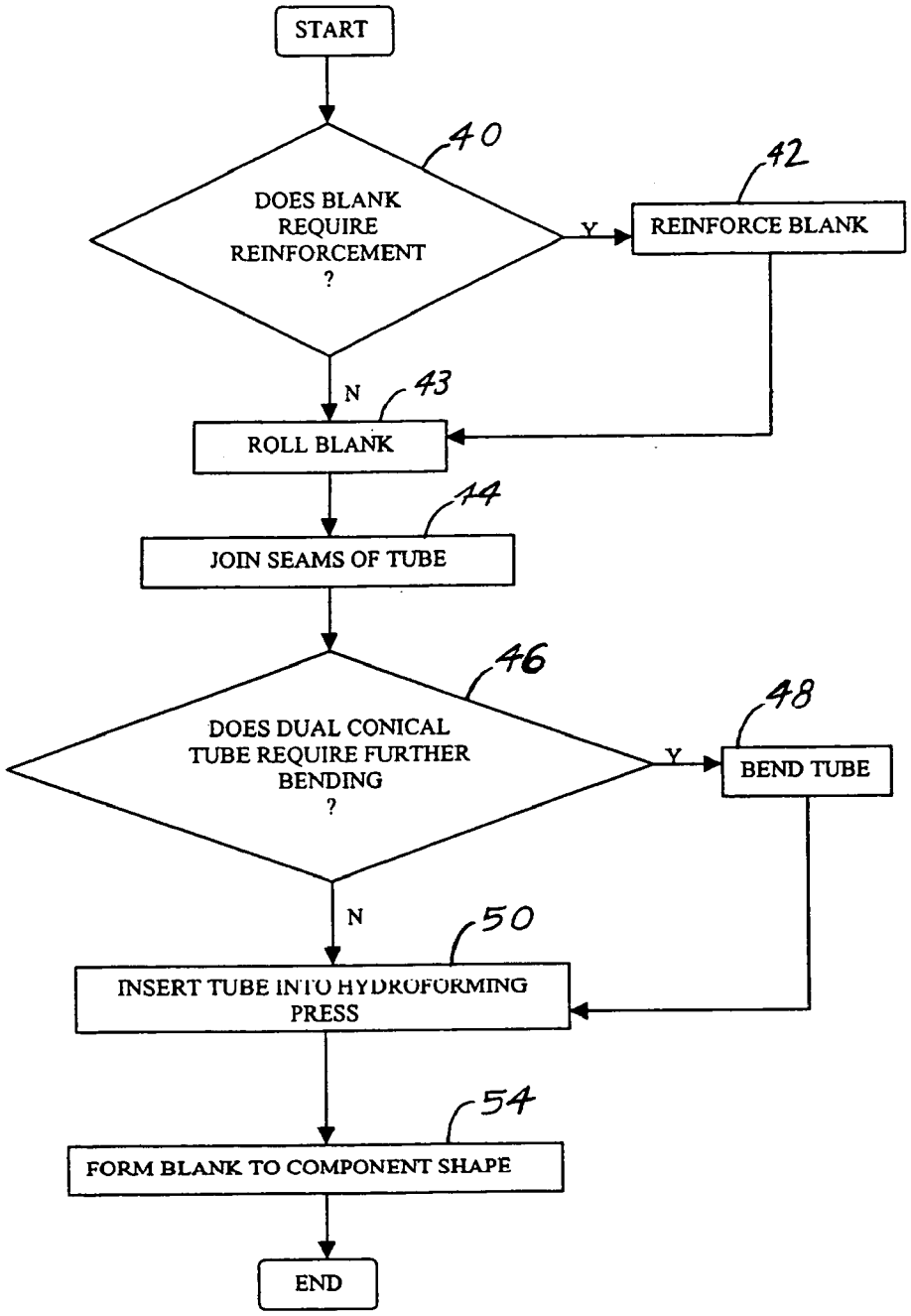
FIG. 3 is a block diagram of a method for hydroforming in accordance with an embodiment of the present invention.

Referring to FIG. 3, a block diagram of a method for hydroforming is disclosed. The method starts in inquiry block 40, when an inquiry is made as to whether the bow tie blank requires reinforcement. For a positive response, the bow tie blank is reinforced in operation block 42 prior to activation of operation block 43, as was mentioned earlier.

Otherwise in operation block 43, the blank is rolled to form a dual conical tube.

Operation block 44 then activates, and the edges of the blank are joined together to form the dual conical tube.

An inquiry is then made in block 46 as to whether the dual conical tube requires further bending to achieve the component shape. For a positive response, operation block 48 activates, and the tube is bent according to component specifications, prior to activation of operation block 50.

Otherwise, operation block 50 activates, and the dual conical tube is inserted into the hydroforming press.

The method concludes in operation block 54 when the bow tie blank is substantially formed to the component shape, as determined by the specific die type used for the hydroforming press.

In operation, a substantially bow tie shaped blank is rolled to form a dual conical tube. The dual conical tube is inserted in a metal forming device having a shaping die. The dual conical tube is formed through pressurization to a shape determined from the die.

From the foregoing, it can be seen that there has been brought to the art a new method for hydroforming. It is to be understood that the preceding description of the preferred embodiment is merely illustrative of some of the many specific embodiments that represent applications of the principles of the present invention. Numerous and other arrangements would be evident to those skilled in the art without departing from the scope of the invention as defined by the following claims.

What is claimed is:

1. A hydroforming system comprising:

a dual conical tube formed from a blank comprising a first end, a second end and a central portion positioned between said first and said second ends, said central portion having a smaller cross sectional area than said first and said second ends; and a shaping die adapted to receive said dual conical tube, said shaping die for applying pressure to said blank so as to substantially form said blank with a shape of said shaping die.

2. The system of claim 1, wherein said blank is substantially bow tie shaped.

3. The system of claim 1, further comprising at least one reinforcement coupled to said blank.

4. The system of claim 1, wherein said shaping die is coupled to a forming system.

5. The system of claim 4, wherein said forming system comprises a hydroforming press.

6. The system of claim 1, wherein said dual conical tube is sufficiently deformable for being bent during a bending process prior to insertion in said shaping die.

7. A hydroforming system comprising:

a dual conical tube formed from a substantially bow tie shaped blank, said dual conical tube comprising a first end, a second end and a central portion positioned between said first and said second ends, said central portion having a smaller cross sectional area than said first and said second ends; and a shaping die adapted to receive said dual conical tube, said shaping die for applying pressure to said blank so as to substantially form said blank with a shape of said shaping die.

8. The system of claim 7, further comprising at least one reinforcement coupled to said substantially bow tie shaped blank.

9. The system of claim 7, wherein said shaping die is coupled to a hydroform press.

10. The system of claim 7, wherein said dual conical tube is sufficiently deformable for being bent during a bending process prior to insertion in said shaping die.

11. A method for molding a part comprising:

rolling a substantially bow tie shaped blank lengthwise to form substantially a dual conical tube shape;

joining seams of said substantially bow tie shaped blank;

inserting said substantially bow tie shaped blank in a metal forming device comprising a shaping die; and substantially forming through pressurization said substantially bow tie shaped blank to an approximate shape of said shaping die.

12. The method of claim 11, further comprising reinforcing said bow tie shaped blank prior to the step of inserting.

13. The method of claim 11, wherein metal forming comprises hydroforming.

14. The method of claim 13, further comprising bending said substantially bow tie shaped blank prior to the step of hydroforming.

15. The method of claim 13, wherein hydroforming includes pressurizing said substantially bow tie shaped blank.

16. The method of claim 11, wherein inserting said substantially bow tie shaped blank in a metal forming device comprises hot-metal gas forming.

17. A part formed according to the method of claim 11 comprising:

a first end;

a second end; and a central portion positioned between said first and said second ends, said central portion having a smaller cross sectional area than said first and said second ends;

wherein said first end said, second end, and said central portion are formed from a substantially bow tie shaped blank.

* * * * *